US005383972A

United States Patent [19]

Waltz

[11] Patent Number: 5,383,972

[45] Date of Patent: Jan. 24, 1995

[54] METHOD OF CARPET CLEANING AND MAINTENANCE

[75] Inventor: Dale A. Waltz, Concord, N.H.

[73] Assignee: Interface Service Management, Inc., Braintree, Mass.

[21] Appl. No.: 3,522

[22] Filed: Jan. 12, 1993

[51] Int. Cl.[6] ..... B08B 3/04

[52] U.S. Cl. ..... 134/26; 134/28; 134/29

[58] Field of Search ..... 134/21, 26, 28, 29, 134/40, 42

[56] References Cited

U.S. PATENT DOCUMENTS

| | | | |
|---|---|---|---|
| 3,919,729 | 11/1975 | Cannan | 134/21 X |
| 4,063,961 | 12/1977 | Howard et al. | 134/21 X |
| 4,154,578 | 5/1979 | Bane | 134/21 X |
| 4,304,610 | 12/1981 | Weisensel | 134/21 |
| 4,595,420 | 6/1986 | Williams, III et al. | 134/21 X |
| 5,180,439 | 1/1993 | Allison | 134/21 |

*Primary Examiner*—Richard O. Dean
*Assistant Examiner*—Saeed Chaudhry
*Attorney, Agent, or Firm*—Laff, Whitesel, Conte & Saret

[57] ABSTRACT

A carpet cleaning and maintenance method wherein the steps of pre-spraying and extracting a solvent from a carpet and applying and extracting a low sudsing detergent from the carpet are alternated.

25 Claims, No Drawings

METHOD OF CARPET CLEANING AND MAINTENANCE

FIELD OF THE INVENTION

This invention relates generally to carpet cleaning and, more particularly, to a method of multi-stage carpet cleaning and maintenance which prevents chemical build-up, enhances colorfastness and extends carpet life.

BACKGROUND OF THE INVENTION

It is important to keep carpets clean. Carpets help purify the environment by accumulating particulates and gasses from the soles of the people who walk over them as well as from the surrounding atmosphere. Soiled carpets however are not aesthetically appealing and wear poorly. Left uncleaned they will eventually release particulates and gasses back into the air. In closed circulation buildings, heavily soiled carpets will cease to help clean the environment and may become a source of air pollution and could contribute to health problems.

Carpet cleaning and maintenance programs have a direct impact on carpet appearance and performance. Proper cleaning and maintenance can keep carpets looking new and beautiful and extend their lifespan. Well maintained carpets absorb soil and gas and contribute to a healthier indoor environment. Conversely, poor cleaning and maintenance can cause carpets to look old and dirty long before they wear out and may pollute the surrounding atmosphere. Additionally, modern carpets which have been pre-treated with soil and stain retardants require special treatment to properly clean them while maintaining their soil and stain resistance.

Carpet cleaning and maintenance conventionally involves the application of a detergent solution to the carpet followed by extraction. Detergents, however, only attack water-soluble dirt. Therefore, when water-insoluble materials, such as grease, are present in the carpet, organic solvents must also be applied and extracted.

Although detergents and organic solvents have conventionally been employed as carpet cleaning agents, as currently applied they can actually be detrimental to carpet appearance. Conventional organic solvents and detergents used in carpet cleaning are highly alkaline and contain optical brighteners and soil retardants. Their pH is generally at least about 10–12. The repeated use of these cleaning agents can lead to detrimental alkaline, soil retardant and optical brightener build-up which promote rapid resoiling and degradation of nylon fiber and additionally can cause carpet color to fade due to enhanced UV sensitivity.

Therefore, it is an object of this invention to provide an improved method of carpet cleaning and maintenance that involves the application of a detergent and an organic solvent to control the levels of both water-soluble and water-insoluble materials, including soiling and stains from use as well as residue from cleaning.

It is also an object of this invention to provide a method of carpet cleaning and maintenance which extends useful carpet life. It is additionally an object of this invention to provide a method of carpet cleaning and maintenance which does not cause alkaline or optical brightener build-up.

Furthermore, it is an object of this invention to provide a method of carpet cleaning and maintenance which assures continued colorfastness.

It is yet another object of this invention to provide a method for rejuvenating the soil retardant and stain resistance characteristics of carpets which were pre-treated to have such attributes.

These and other objects and advantages of the present invention will become apparent from the following specification and claims.

SUMMARY OF THE INVENTION

The method of the invention calls for a carpet cleaning cycle comprising two alternating steps. One step involves pre-spraying carpet with a solvent and extracting, and the other step involves applying and extracting a low sudsing detergent solution from the carpet. By alternating these two steps, both water-soluble and water-insoluble materials are removed, thereby extending carpet life while preventing alkaline, soil retardant and optical brightener build-up and the fading of carpet color.

Additionally, in one preferred embodiment, the carpets are rinsed or otherwise treated with a weak acid such as acetic or tannic acid, preferably at a pH of about 2.5 to 3.5, to prepare the carpet fibers to take up stain resistance boosters—typically fluorochemicals—and soil retardants, after which such chemical treatments are applied.

DETAILED DESCRIPTION OF THE INVENTION

In the practice of the present invention, two alternating extraction steps are used for carpet cleaning and maintenance. One step involves pre-spraying and extraction and the other involves conventional extraction. Generally, either step may be used first, but the alternate step should be used on the next occasion that extraction is performed. However, if the carpet was previously cleaned by another method, the pre-spray/extraction step should be used first.

In accordance with the present invention, carpet is pre-sprayed with a solvent, and preferably with an emulsified solvent. The solvent may be chosen from the group comprising butyl and glycol ethers or alcohols. In a preferred embodiment, emulsified butyl is used, at a level effective in emulsifizing oils and grease in the carpet, up to a maximum of about 2% by volume. The pH of the solvent should be in the range of about 8.0 to 10.5, preferably in the range of about 9.0 to 9.6, and most preferably in the range of about 9.2 to 9.6.

The solvent should remain on the carpet for at least about 8 minutes and for no more than about 30 minutes. A minimum dwell time of about 8 minutes is required to emulsify oils and grease in the carpet. Dwell times in excess of 30 minutes can lead to drying of the solvent to a crystalline form which will not redissolve in water and thus becomes effectively inert. It is preferred that the solvent remain on the carpet for about 8 to 10 minutes.

After remaining on the carpet for the desired period of time, the solvent is extracted from the pre-sprayed carpet preferably by agitating the carpet with brush action and rinsing with clear water in the temperature range of about 60° to 120° F., and preferably in the range of about 95° to 105° F. The extraction may be performed with any self-contained carpet cleaning equipment. A detergent solution is then applied to the carpet by spraying. The solution will preferably consist of a cationic or anionic low sudsing detergent in hot water in the temperature range of about 60° to 120° F. and preferably in the range of about 95° to 105° F. The pH of the low sudsing detergent should be in the range of about 7 to 12, preferably in the range of about 10 to 11, and most preferably in the range of about 10 to 10.5. The detergent solution is then extracted from the carpet preferably with brush action.

The frequency of carpet cleaning and maintenance by alternating the two extraction steps is critical and depends upon the traffic experienced by particular carpeting, i.e., the rate of soiling. A high traffic area is one in which there is frequent and concentrated traffic with over 2000 walkons per day on a 6 to 8 foot wide passageway. A moderate traffic area is one in which there is frequent random traffic and regular traffic with up to 2000 walkons per day on a 6 to 8 foot wide passageway. A minimum traffic area is one in which up to 1000 walkons occur per day on a 6 to 8 foot wide passageway. In one twelve month period, high traffic areas should receive an alternating cycle of 6–26 of each of the two extraction steps, whereas moderate traffic areas should receive an alternate cycle of 3–8 of each of the two extraction steps, and minimum traffic areas should receive an annual cycle of 2–4 of each of the two extraction steps. Also, as a practical matter, when cleaning adjacent areas subject to different levels of traffic, practical considerations may dictate that the initial cleaning of a low traffic area would be done at the same time as an adjacent higher traffic area and then the desired cleaning intervals maintained.

EXAMPLE

The following example is intended to be illustrative of the present invention and to teach one of ordinary skill how to make and use the invention. This example is not intended to limit the invention or its protection in any way.

In this example a carpet cleaner having a low foaming wetting agent and dual surfactant system with optical brighteners and soil retardant/stain resistance chemicals and a pH of not more than 9.5 was used along with a carpet pre-spray and spotter having a blend of emulsified solvents and crystallizing agents which leaves no residue to contribute to resoiling and a pH of not more than 10.5. The actual carpet cleaner and carpet pre-spray and spotter were products of International Service System, Inc. of New York, N.Y., available respectively under the product codes CC502 (cationic detergent with optical brighteners and soil retardants with a pH of 10.5 in dilution), CC507 (anionic detergent without optical brighteners or soil retardants, pH 7–7.3 in dilution), and CC509 (dual solvent, water-based with no optical brighteners or soil retardants or surfactant, with a pH of 9.0).

Using the alternating cleaning method (pre-spray extraction/conventional extraction) of the present invention, a total of thirty-four extractions were completed. This number of extractions is equivalent to approximately seventeen years use in low traffic areas, eight and one-half years use in moderate traffic areas, and nearly three years use in heavy traffic areas.

CC509 was used for the pre-spray extraction method. The CC509 was sprayed directly onto the carpet. The pH was in the range of about 9 to 10. It was allowed an eight to ten minute dwell time and then extracted with clean water at about 90° F.

CC502 was used for the conventional extraction method. Two ounces of CC502 were added for every gallon of hot water in the extractor's solution tank. The diluted CC502 solution, which had a pH in the range of about 10 to 10.5, was applied to the carpet and extracted.

The carpet products and colors tested, along with the results obtained through the use of the alternating extraction cleaning method, are illustrated in the following Table.

TABLE

| Carpet Description | Results |
|---|---|
| Synerpoint ® (Loop construction) | |
| Smoke | Acceptable color retention for all colors. |
| Denim | Acceptable color retention for all colors. |
| Risotto | Acceptable color retention for all colors. |
| Eucalyptus | Acceptable color retention for all colors. |
| Palette Plus ® Flecks 3000 (Cut pile construction) | |
| Color unidentified | Acceptable color retention. |
| Color unidentified with overprint | Acceptable color and print retention. |
| Palette Plus ® Tweeds 4000 (Cut pile construction) | |
| Color unidentified with overprint | Acceptable color and print retention. |
| Quantum Plus ® (Loop construction) | |
| Color unidentified with overprint | Acceptable color and print retention. |

Carpets available from Interface Flooring Systems, Inc. of LaGrange, Georgia.

These results indicate that colorfastness is well within acceptable ranges of colorfast testing by The Carpet and Rug Institute.

While the present invention is described above in connection with preferred or illustrative embodiments, these embodiments are not intended to be exhaustive or limiting of the invention. Rather, the invention is intended to cover all alternatives, modifications, and equivalents included within its spirit and scope, as defined by the appended claims.

What we claim is:

1. A method of cleaning and maintaining a carpet comprising the steps of:
   a. determining the number of walkons per day of the carpet;
   b. after a period of time dependent on the number of walkons per day of the carpet, spraying the carpet with a solvent effective in emulsifying oils and grease in the carpet and extracting the solvent from the pre-sprayed carpet;
   c. waiting a period of time dependent on the number of walkons per day of the carpet;
   d. applying and extracting a low sudsing anionic or cationic detergent solution from the carpet; and
   e. repeating step (b).

2. The method of claim 1 in which the period of time dependent on the number of walkons of the carpet is 12 months.

3. The method of claim 1 in which the period of time dependent on the number of walkons of the carpet is 4 months.

4. The method of claim 1 in which the period of time dependent on the number of walkons of the carpet is 2 months.

5. The method of claim 1 in which the solvent is chosen from the group consisting of butyl and glycol ethers or alcohols.

6. The method of claim 5 in which the solvent is butyl ether or alcohol.

7. The method of claim 1 in which the pH of the solvent ranges from about 8.0 to 10.5.

8. The method of claim 7 in which the pH range of the solvent ranges from about 9.0 to 9.6.

9. The method of claim 8 in which the pH range of the solvent ranges from about 9.2 to 9.6.

10. The method of claim 1 in which the solvent is extracted from the pre-sprayed carpet after about 9 to 30 minutes.

11. The method of claim 10 in which the solvent is extracted from the pre-sprayed carpet after about 8 to 10 minutes.

12. The method of claim 1 in which the solvent is extracted from the pre-sprayed carpet by agitating the carpet and rinsing.

13. The method of claim 12 in which the carpet is agitated with brush action and rinsed with water at a temperature in the range of about 60° to 120° F.

14. The method of claim 1 in which the low sudsing detergent solution consists of a low sudsing detergent and water having a temperature in the range of about 60° to 120° F.

15. The method of claim 14 in which the low sudsing detergent is a cationic detergent.

16. The method of claim 15 in which the low sudsing detergent is an anionic detergent.

17. The method of claim 1 in which the pH range of the low sudsing detergent solution ranges from about 7 to 12.

18. The method of claim 17 in which the pH range of the low sudsing detergent solution ranges from about 10 to 11.

19. The method of claim 18 in which the pH range of the low sudsing detergent solution ranges from about 10 to 10.5.

20. The method of claim 1 in which the low sudsing detergent solution is extracted from the carpet while agitating the carpet.

21. The method of claim 20 in which the carpet is agitated with brush action.

22. The method of claim 1 in which the order of steps (b) and (d) are reversed.

23. The method of claim 1 in which the carpet is treated with a weak acid to prepare the carpet fibers to take up stain resistance boosters and soil retardants, after which such chemical treatments are applied.

24. The method of claim 23 in which the weak acid has a pH in the range of about 2.3 to 3.5.

25. The method of claim 24 in which the acid is chosen from the group consisting of acetic and tannic acid.

* * * * *